US005780757A

United States Patent [19]

Valtchev et al.

[11] Patent Number: 5,780,757

[45] Date of Patent: Jul. 14, 1998

[54] ACOUSTICAL RING AND BELL SOUND SYSTEM

[75] Inventors: Konstantin L. Valtchev; Harold Gomez, both of Ontario, Canada

[73] Assignee: Valgon Sound, Canada

[21] Appl. No.: 837,757

[22] Filed: Apr. 22, 1997

[51] Int. Cl.[6] ..... G10D 7/00

[52] U.S. Cl. ..... 84/380 R; 84/384

[58] Field of Search ..... 84/380 R, 382, 84/383 R, 384, 386, 385 R, 387 R, 394, 395, 398, 400, 453

[56] References Cited

U.S. PATENT DOCUMENTS

| | | | |
|---|---|---|---|
| 510,119 | 12/1893 | Clinton | 84/386 |
| 2,292,584 | 8/1942 | Tafarella | 84/383 |
| 4,428,271 | 1/1984 | Winslow et al. | 84/383 R |
| 5,000,073 | 3/1991 | Hite | 84/383 R |
| 5,440,962 | 8/1995 | Valtchev | 84/383 R |

*Primary Examiner*—Michael L. Gellner
*Assistant Examiner*—Shih-yung Hsieh
*Attorney, Agent, or Firm*—Henderson & Sturm

[57] ABSTRACT

An acoustical ring and bell sound system 10 for use with a variety 101, 102, 103 of musical wind instruments 100; wherein, the sound system comprises an acoustical ring element 21 and an acoustical bell element 31 dimensioned to releasably engage the proximal 104 and distal 105 ends of the musical instrument 100 for producing air turbulence control in the interior of the instrument 100.

20 Claims, 6 Drawing Sheets

ACOUSTICAL RING AND BELL SOUND SYSTEM

CROSS REFERENCE TO RELEATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of accessories for musical instruments in general, and in particular to a system for controlling the internal air turbulence in a musical wind instrument.

2. Description of Related Art

As can be seen by reference to the following U.S. Pat. Nos. 2,292,584; 4,428,271; 5,000,073; and 5,440,962; the prior art is replete with myriad and diverse reed ligature construction for maintaining a reed at a desired location on a wind instrument.

While all of the aforementioned prior art constructions are more than adequate for the basic purpose and function for which they have been specifically designed, they are uniformly deficient with regard to controlling the air turbulence on the inside of a musical wind instrument.

In the past, the turbulence generated within the musical instrument as a natural by-product of the forced passage of air necessary to generate the musical notes, also made it extremely difficult for the musician to connect the diverse notes evenly in all registers. In addition, the turbulence caused the playing of the various instruments to be more physically stressful and reduced the percentage of reeds that could be effective employed by other than the most skillful musicians.

As a consequence of the foregoing situation, there has existed a longstanding need for a new type of sound system which produces resonance on the exterior of a musical instrument to reduce the turbulence within woodwind and brass instruments bores, and the provision of such a construction is a stated objective of the present invention.

BRIEF SUMMARY OF THE INVENTION

Briefly stated, the acoustical ring and bell sound system that forms the basis of the present invention comprises in general a pair of hollow housing members wherein one of the housing members comprise an acoustical ring element which is normally deployed at the barrel or neck of a musical instrument. The other housing member comprises an acoustic bell element which is normally deployed at the distal end or bell of a musical instrument.

As will be explained in greater detail further on in the specification, each of the housing members are secured on the opposite ends of the musical instrument by a pair of spring biased shoe elements which releasably engage portions of the musical instruments.

The sound system of this invention is a totally new way to create resonance on the outside of the instrument producing a faster control of the air turbulence on the inside of the instrument. This system produces resonance in the air space between the surface of the instrument and the acoustical ring and the acoustical bell. The increased resonance quickly settles the turbulence within the woodwind and brass instrument bore.

This results in notes being connected evenly in all registers. The additional source of resonance permits better projection of the sound with less physical stress. A better focused and more even tone is produced with considerably less effort. The disruption of tone in critical places such as over the breaks will now be smooth as turbulence in the bore of the instrument is quickly adjusted to connect each note of the scale in a legato and centered way.

The results are so profound that the conductor, adjudicator, teacher and even family members will immediately hear the improvement in someone's playing. The acoustical system of this invention can also be used with both woodwind and brass instruments.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1A:
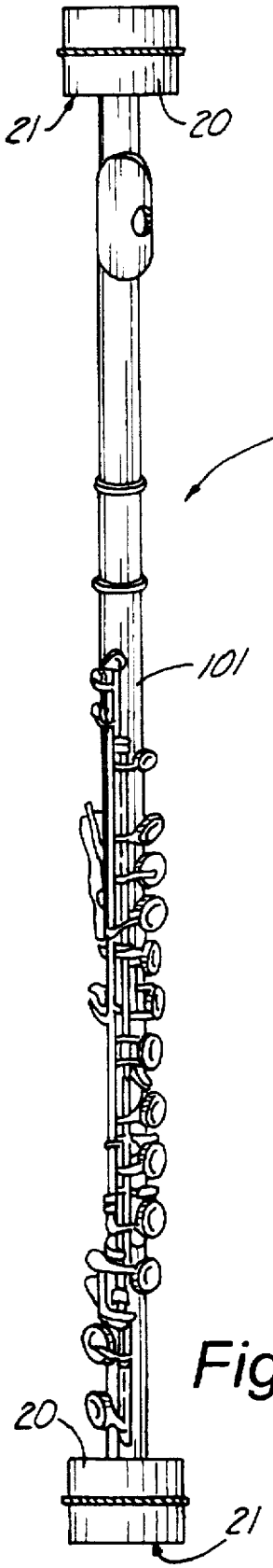
FIG. 1A is a perspective view of the acoustical ring sound system which engages the opposite ends of a flute.
Figure 1B:
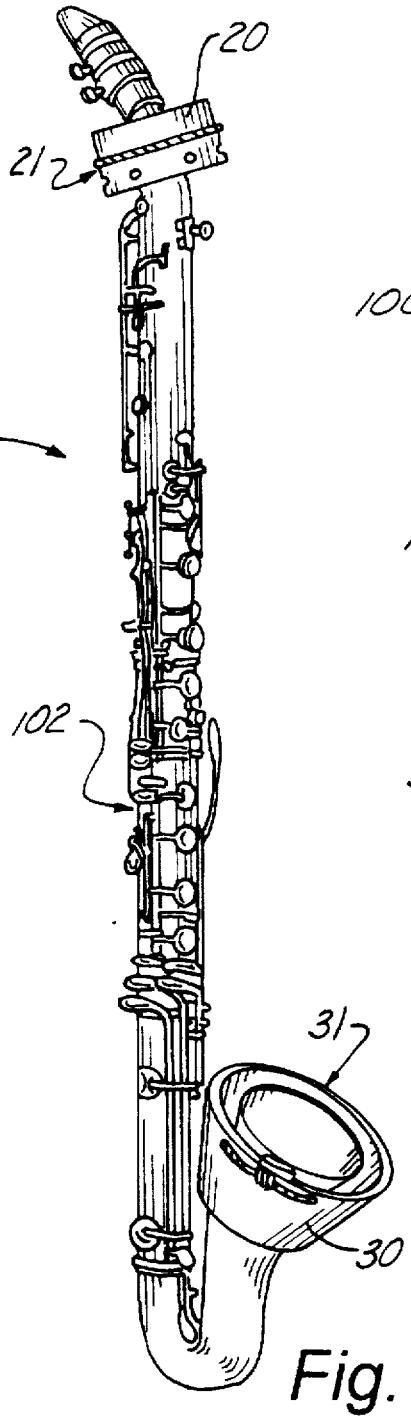
FIG. 1B is a perspective view of the acoustical ring and bell sound system which engages the opposite ends of an alto clarinet.
Figure 1C:
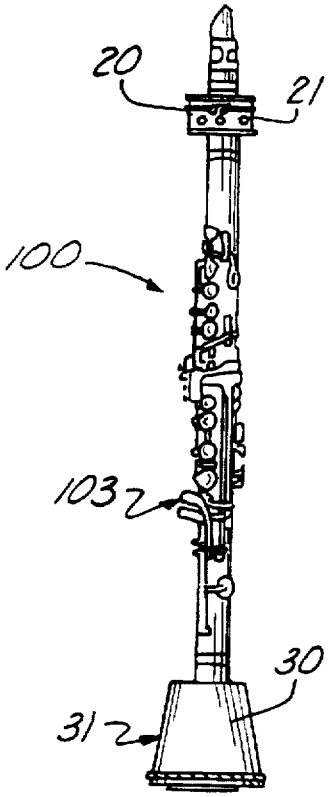
FIG. 1C is a perspective view of the acoustical ring and bell sound system which engages the opposite ends of a b-flat clarinet.

As can be seen by reference to the drawings, and in particularly to FIG. 1, the acoustical ring and bell sound system that forms the basis of the present invention is designated generally by the reference number 10. The sound system comprises in general a pair of housing members 20 and 30 which are adapted to releasably engage the opposite ends of a variety of musical instruments such as flute 101, alto clarinet 102, b-flat clarinet 103, or other woodwind or brass musical instrument, including but not limited to, piccolos, saxophones, etc. The housing members 20 and 30 will now be described in seriatim fashion.

As shown in FIGS. 2 through 5, the first housing member 20 comprises a generally cylindrical acoustical ring element 22 wherein the distal and proximal ends of the ring element 22 are provided with reinforced lips 23 and the intermediate periphery of the ring element 22 may optionally be provided with a plurality of apertures 24 whose purpose and function will be described in greater detail further on in the specification.

Figure 2:
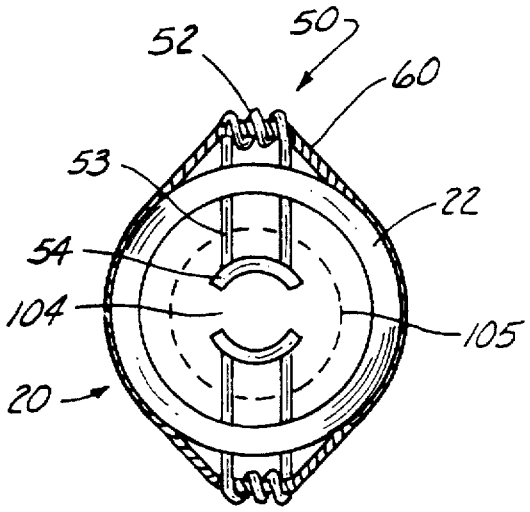
FIG. 2 is an end view of an acoustical ring grasping an instrument having a narrow neck.
Figure 3:
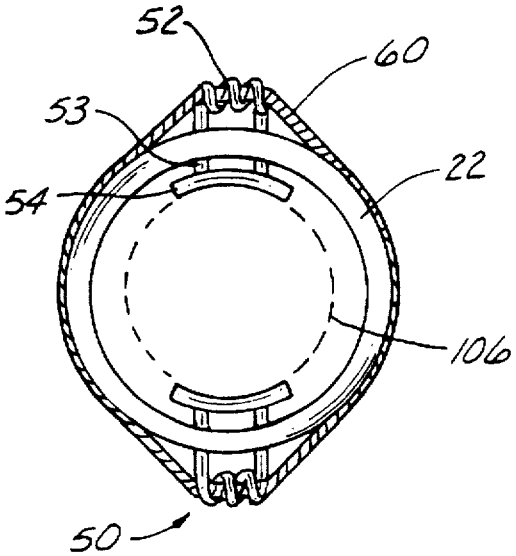
FIG. 3 is an end view of an acoustical ring grasping an instrument having an enlarged neck.
Figure 4:
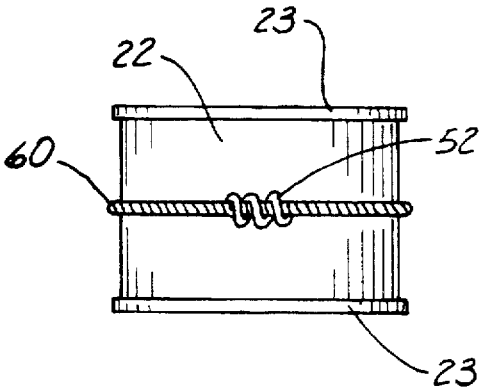
FIG. 4 is a top plan view of the exterior of one acoustical ring configuration.
Figure 5:
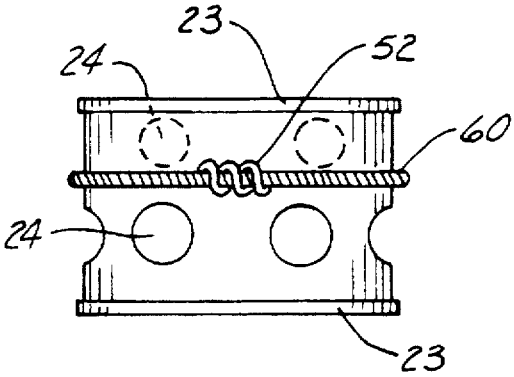
FIG. 5 is a top plan view of the exterior of another acoustical ring configuration.

In addition, as depicted in FIGS. 2 and 3, the interior of the acoustical ring element 22 is dimensioned to receive the barrel 104 or neck 105 portions of a musical instrument 100.

Figure 6:
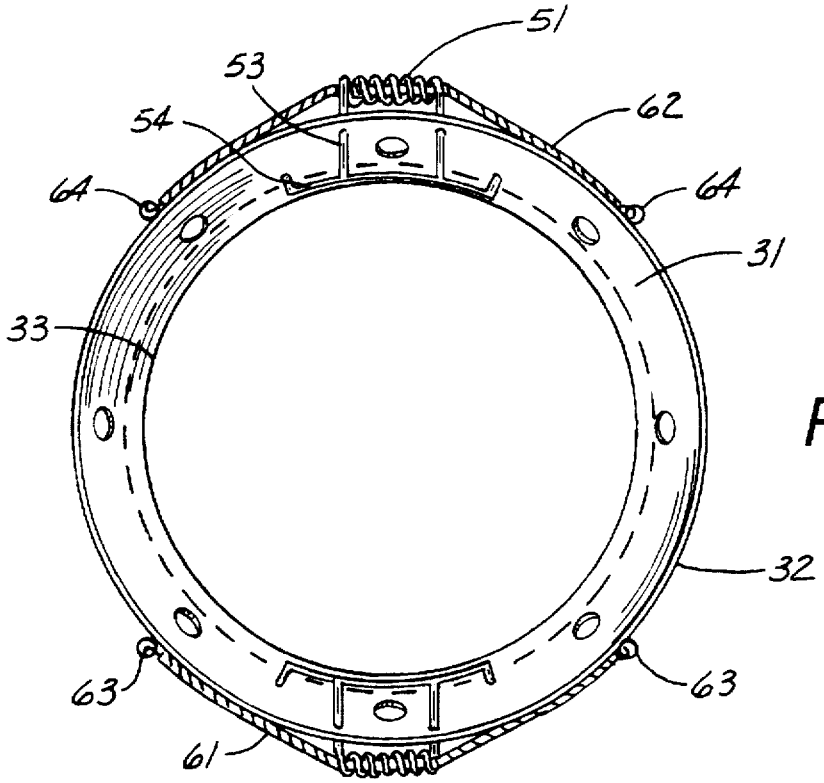
FIG. 6 is an end view of an enlarged apertured acoustical bell.
Figure 7:
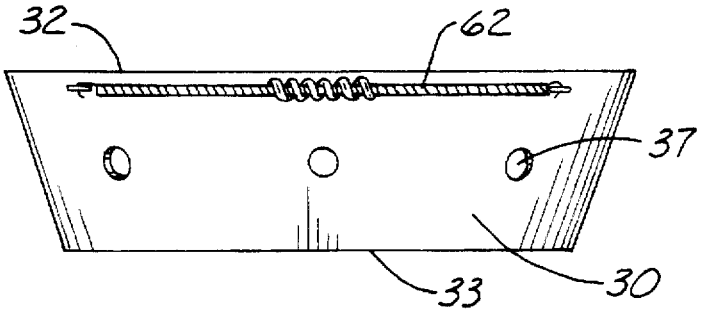
FIG. 7 is a top plan view of the apertured acoustical bell of FIG. 6.
Figure 11:
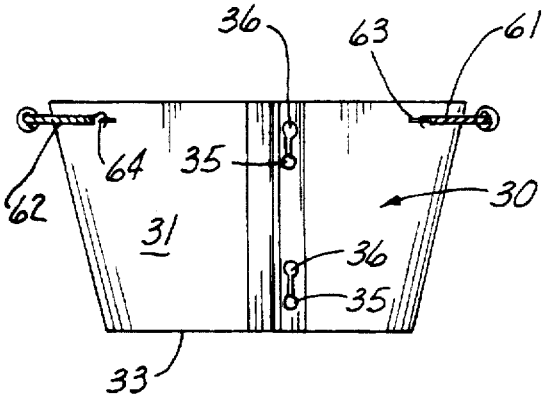
FIG. 11 is a top plan view of the split ring version of FIG. 9.
Figure 12:
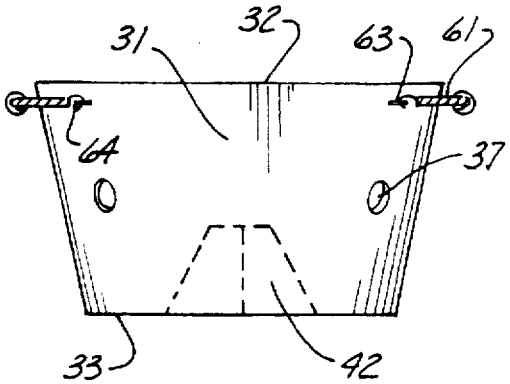
FIG. 12 is a bottom plan view of the split and notched version of FIG. 10.
Figure 13:
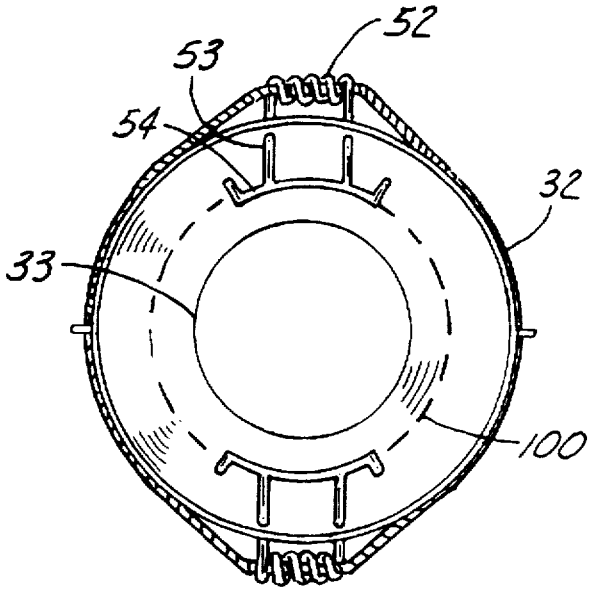
FIG. 13 is an end view of the smaller one-piece version of the acoustical bell.

Turning now to FIGS. 6 through 14, it can be seen that the second housing member 30 comprises a generally conical acoustical bell element 31 having an enlarged diameter distal end 32 and a reduced diameter proximal end 33. As shown in FIGS. 6, 9, 10, and 13, the acoustical bell element 31 is manufactured in different sizes so that the reduced diameter proximal end can slip over the distal end of a variety of musical instruments 100. Furthermore, the acoustical bell element 31 may be fabricated as a generally rigid smooth continuous member as depicted in FIGS. 6 and 13. Element 31 may be split as at 34 in FIGS. 9 through 11 to impart some flexibility to the bell element 31, and can slip over the distal end of a variety of musical instruments in open positions.

Figure 9:
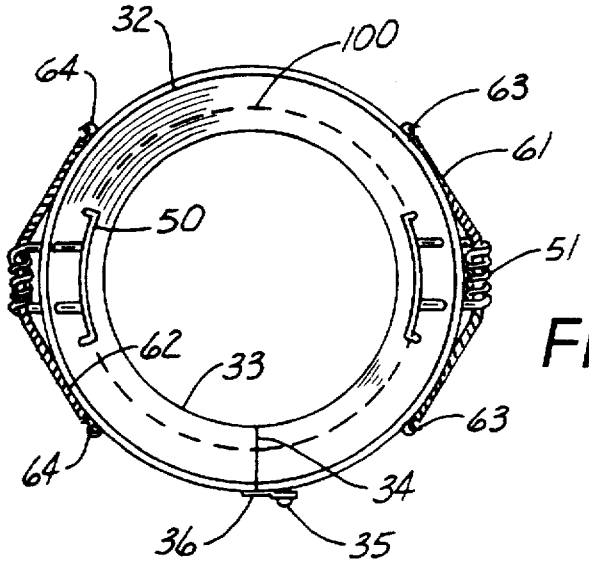
FIG. 9 is an end view of the split ring version of the acoustical bell.
Figure 10:
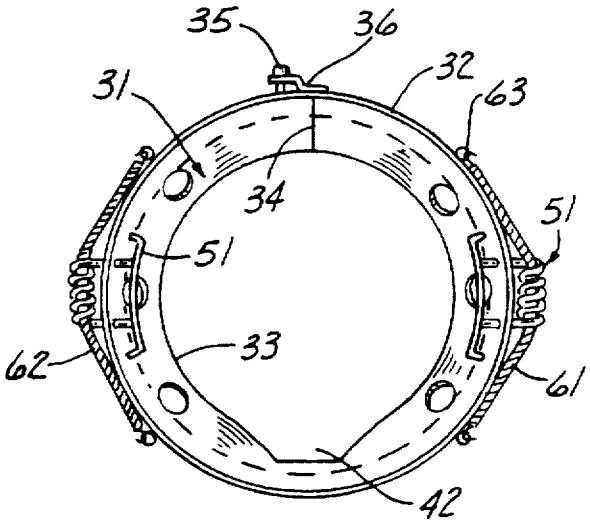
FIG. 10 is an end view of the split and notched version of the acoustical bell.

As can best be seen by reference to FIGS. 9 through 11, in the split ring version of the acoustical bell element 31 the opposed ends of the bell element 31 are provided with a post 35 and catch 36 assembly which joins the opposed ends of the split ring version of the bell element 31 in a well recognized fashion.

Figure 8:
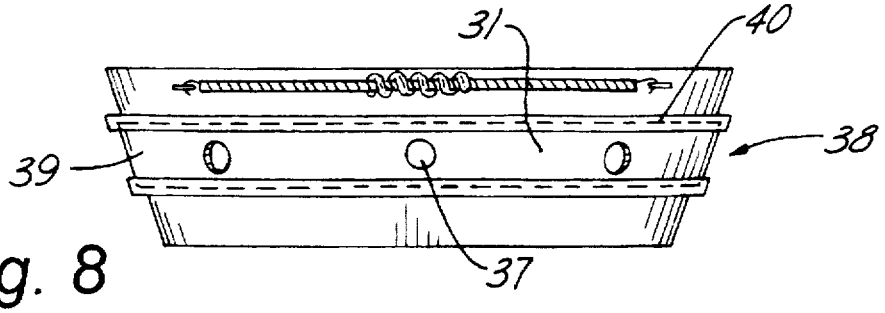
FIG. 8 is a top plan view of a modified version of the acoustical bell depicted in FIG. 6.

In addition, as shown in FIGS. 6 through 8, and 12, the second housing member 30 may likewise be provided with a plurality of apertures 37. As shown in particular in FIG. 8, an aperture control member 38 may be installed on the outer periphery of the acoustical bell element 31 to selectively cover the apertures 37 to achieve different tones to the musical notes. In the embodiment of FIG. 8, the aperture control member 38 comprises a belt 39 and groove 40 arrangement. However, other aperture control arrangements may be substituted therefor.

At this junction, it should be apparent that both the acoustical ring element 21 and the acoustical bell element 31 share a number of structural similarities Those similarities also extend to the releasable securing means 50 that are employed for operatively engaging the two housing members 20 and 30 to the opposite ends of the musical instruments 100.

As shown in FIGS. 2, 3, 9, 10 and 16, the releasable securing means 50 comprises a pair of opposed spring biased shoe elements 51. Each of the shoe elements 51 include an outwardly projecting handle member 52, a pair of inwardly extending leg members 53 which pass through suitably dimensioned discrete apertures (not shown) in the respective housing members 20 and 30, and an inner contoured shoe member 54 dimensioned to receive a portion of the periphery of the musical instruments 100.

Figure 15:
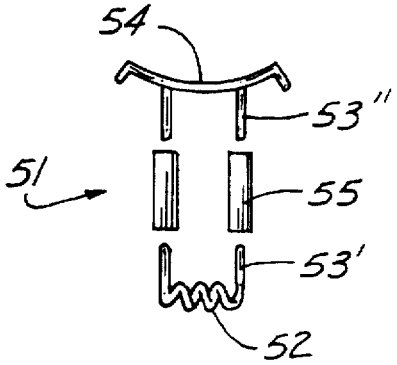
FIG. 15 is an exploded perspective view of the multi-piece shoe of this invention.
Figure 14:
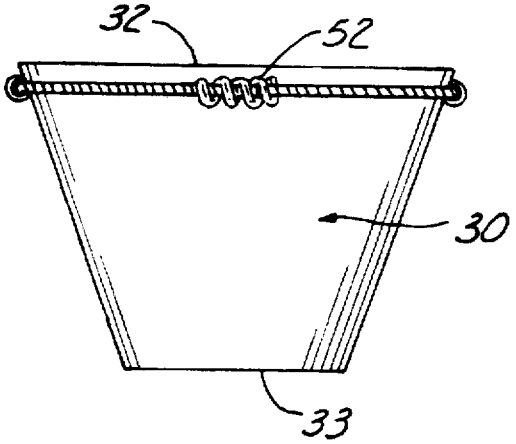
FIG. 14 is a top plan view of the one-piece version.
Figure 16:
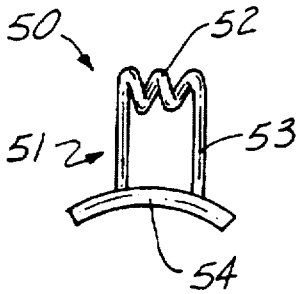
FIG. 16 is a front plan view of the one-piece shoe.
Figure 17:
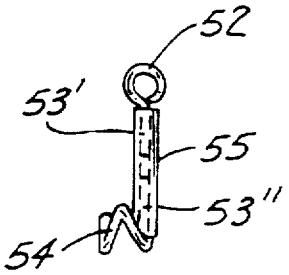
FIG. 17 is a side plan view of the multi-piece shoe.

In an alternate version of the invention depicted in FIGS. 15 and 17, each of the shoe elements 51 have upper 53' and lower 53" leg segments which are connected to one another by a tubular coupler 55 which extends the effective length of the shoe element 51.

As shown in FIGS. 2, 3, 9, and 10, depending on the size of the respective housing members 20 and 30, the shoe elements 51 may be operatively connected to the housing members 20, 30 by a single elongated spring member 60 or by a pair of independently acting spring members 61, 62 which are operatively connected to the outer periphery of the housing members 20, 30 by two pairs of post elements 63, 63 and 64, 64.

Turning now to FIGS. 10 and 12, it can be seen that while inmost instances the interior of the acoustical ring elements 31 will have a uniform configuration, there will be certain instances wherein a contoured notch 42 will have to be provided in the proximal end 33 of the acoustical bell element 31 to accommodate a given protrusion, such as the bar that connects the bell to the body of the saxophone (not shown).

Returning once more to FIG. 1, it can be seen that while in most instances the housing members 20 and 30 are disposed on opposite ends of the musical instrument 100, in the case of the flute 101, the first housing member 20 comprising the acoustical ring element 21 is disposed on the opposite ends of the flute 101.

Figure 18:
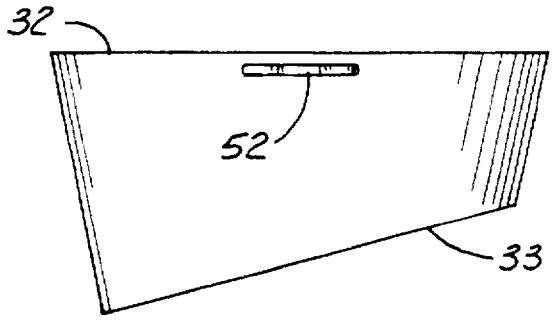
FIG. 18 is a top plan view of an alternate version of the acoustical bell.
Figure 19:
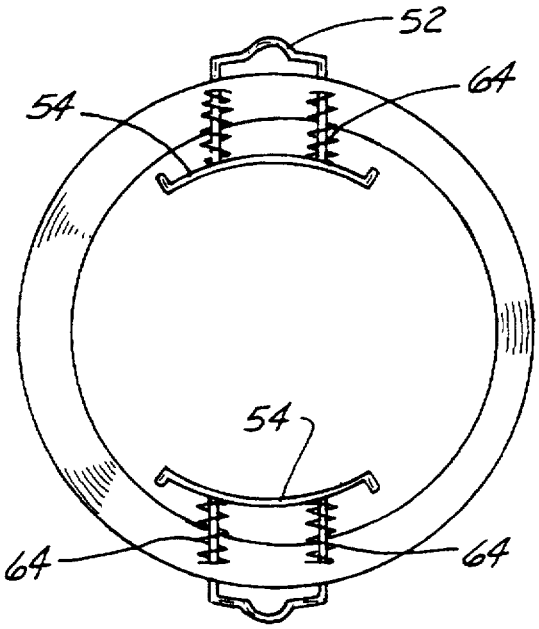
FIG. 19 is a front plan view of the alternate version of the acoustical bell.
Figure 20:
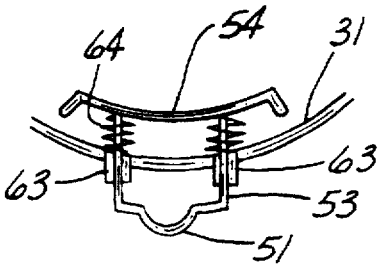
FIG. 20 is a cross sectional view taken through line 20—20 of FIG. 19.

In another alternate version of the preferred embodiment illustrated in FIGS. 18 through 20, it can be seen that there are certain instances wherein the shape of the acoustical bell 30 must be contoured in order to accommodate the curvature of the bell of a particular instrument 100 such as a saxophone or the like (not shown). In the embodiment depicted in FIGS. 18 and 19, it can be seen that the reduced diameter proximal end 33 is angularly disposed relative to the enlarged diameter distal end 33 of the acoustical bell 30 to accomplish that objective.

Still referring to FIGS. 18 through 20, it can be seen that in this particular version of the preferred embodiment, the reduced diameter proximal end 32 is provided with opposed pairs of guide tubes 63 which are dimensioned to receive the inwardly extending leg members 53 of the spring biased shoe elements 51; wherein each of the leg members 53 is provided with individual spring biasing elements 64. In addition, the spring biasing elements 64 are disposed intermediate the contoured shoe member 54 and the interior of the proximal end 32 of the acoustical bell element 31.

Figure 21:
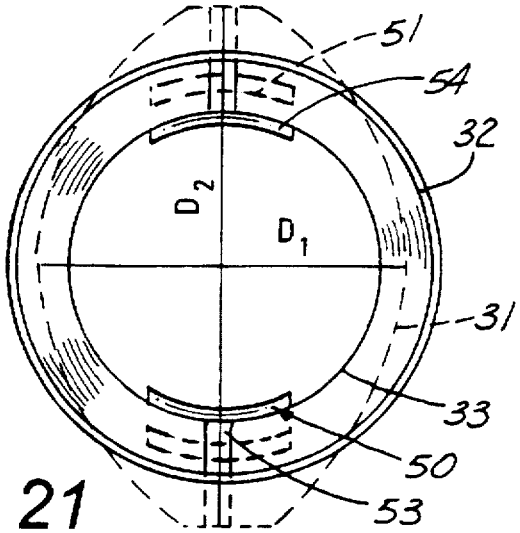
FIG. 21 is a front plan view of yet another alternate version of the acoustical bell.

In yet another alternate version of the invention depicted in FIG. 21, it can be seen that the acoustical bell element 31 is fabricated from a semi-rigid yet resilient thin walled material, such as plastic or the like, wherein, the opposite sidewalls of the bell element 31 may be deformed to change the configuration of the proximal end 32 of the bell element 31 from generally circular to generally elliptical configuration.

In addition, in this version of the invention, the releasable securing means 50 comprises a pair of shoe elements 51 formed integrally with, or permanently affixed to, the interior walls of the bell element 31 in a diametrically opposed fashion.

Furthermore, each of the shoe elements 51 comprise a single elongated leg member 53 which projects inwardly from the interior of the bell element 31 and an arcuate contoured shoe member 54 which extends outwardly from both sides of the leg member 53.

As can also be seen by reference to FIG. 21, the forcible deformation of the sidewalls of the bell element 31 will raise and lower the shoe elements 51 into and out of engagement with the periphery of a musical instrument.

It should further be appreciated at this juncture that this invention also contemplates that both the acoustical ring and bell constructions described herein may be permanently attached to the various instruments at the time that the instruments are manufactured.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. An acoustical ring and bell sound system for engagement with distal and proximal ends of a variety of musical wind instruments wherein the sound system comprises:

a pair of hollow housing members dimensioned to surround the distal and proximal ends of said musical wind instrument wherein each hollow housing member is provided with a plurality of shoe elements which are engaging a selected portion of the periphery of the distal and proximal ends of said musical instrument.

2. The sound system as in claim 1 wherein at least one of the hollow housing members comprises a generally cylindrical acoustical ring element.

3. The sound system as in claim 2 wherein at least one of the hollow housing members comprises a generally conical acoustical bell element.

4. The sound system as in claim 2 wherein both of the hollow housing members comprise said generally cylindrical acoustical ring element.

5. The sound system as in claim 1 wherein each of the shoe elements include an outer handle member, at least one inwardly projecting leg member and an inner contoured shoe member dimensioned to engage a portion of said musical wind instrument.

6. The sound system as in claim 5 wherein each of the shoe elements include pair of inwardly projecting leg members which are dimensioned to be slidably received in suitably dimensioned discrete apertures in said housing members.

7. The sound system as in claim 1 wherein at least one of said housing members is provided with a plurality of apertures.

8. The sound system as in claim 7 wherein said at least one housing member is provided with means to selectively cover said plurality of apertures.

9. The sound system as in claim 1 wherein at least one of said housing members is a rigid continuous member.

10. The sound system as in claim 1 wherein at least one of said housing members is a flexible split member.

11. The sound system as in claim 1 wherein each of said shoe elements are biased inwardly by a single spring element.

12. The sound system as in claim 1 wherein each of said shoe elements are biased inwardly by independent spring elements.

13. The sound system as in claim 1 wherein the distal and proximal ends of at least one of said housing members are provided with reinforced lips.

14. The sound system as in claim 3 wherein said ring element has a generally uniform interior configuration.

15. The sound system as in claim 3 wherein said conical acoustical bell element has an interior configuration provided with a notch dimensioned to receive an outwardly projecting portion of a musical wind instrument.

16. The sound system as in claim 3, wherein, each of the hollow housing members has an opening formed in the distal end and the proximal end.

17. The sound system as in claim 16, wherein, the distal end opening and the proximal end opening are aligned generally parallel to one another.

18. The sound system as in claim 16, wherein, at least one of the housing members has a distal end opening that is larger than the proximal end opening.

19. The sound system as in claim 18, wherein, the distal end opening and the proximal end opening of said at least one housing member are aligned generally parallel to one another.

20. The sound system as in claim 18, wherein, the distal end opening and the proximal end opening of said at least one housing member are disposed at an angle relative to one another.

* * * * *